US005745930A

United States Patent [19]

Fallen

[11] Patent Number: 5,745,930

[45] Date of Patent: May 5, 1998

[54] TOILET SEAT LIFTING DEVICE

[76] Inventor: Christopher L. Fallen, 3021 Monument Ave., Apt. #2, Richmond, Va. 23221

[21] Appl. No.: 743,170

[22] Filed: Nov. 4, 1996

[51] Int. Cl.[6] ..... A47K 13/10

[52] U.S. Cl. ..... 4/246.1

[58] Field of Search ..... 4/246.1–246.5

[56] References Cited

U.S. PATENT DOCUMENTS

| | | | |
|---|---|---|---|
| 2,236,576 | 4/1941 | Loebner | 4/246.1 |
| 3,345,650 | 10/1967 | Waters . | |
| 4,129,907 | 12/1978 | Vaughan et al. . | |
| 4,805,246 | 2/1989 | De Vargas et al. . | |
| 4,920,586 | 5/1990 | Giallourakis . | |
| 4,951,324 | 8/1990 | Lirette | 4/246.1 |
| 5,027,472 | 7/1991 | Goodman . | |
| 5,341,519 | 8/1994 | Cusenza . | |
| 5,459,889 | 10/1995 | Jamison . | |

*Primary Examiner*—Charles E. Phillips
*Attorney, Agent, or Firm*—Chase & Yakimo

[57] ABSTRACT

A lift assembly for a toilet seat includes an arcuate housing mounted to the underside of the toilet seat. First and second socket arms are received within the housing and present a socket at the ends thereof, the sockets positioned at the sides of the seat proper. The sockets releasably engage hubs extending from each handle, the handles being rotated between a depending position and second functional position for raising or lowering the seat. Flanges on the handle hub are releasably engageable with grooves and a slot within the socket so as to provide for positioning of the handle.

20 Claims, 5 Drawing Sheets

TOILET SEAT LIFTING DEVICE

BACKGROUND OF THE INVENTION

This invention relates to toilet apparatus and, more particularly, to a device for lifting and lowering a toilet seat without the need for user manipulation of the toilet seat proper.

One concern, particularly in public facilities, is the potential transfer of bacteria associated with raising and/or lowering a conventional toilet seat. Due to its location and use, a toilet seat may be unsanitary particularly if not disinfected after each use.

In response thereto various structures have been proposed which enable a user to manipulate a toilet seat between its raised and lowered positions without the need to touch the seat proper. Although assumably effective in operation, such devices do not address an easy attachment and/or removal of one or more lift handles to one or more slots of the seat proper so as to clean and disinfect the same. Moreover, it is also desirable to place the handles at a position during nonuse which will not interfere with conventional use of the toilet apparatus.

In response thereto I have invented a lifting assembly for a toilet seat comprising an arcuate housing mounted to the underside of the toilet seat proper. First and second arcuate socket arms present free ends that are slidably received within the mounting housing and are further attached to the underside of the seat proper. A socket is presented at the opposed free end of each arm for receiving a handle therein. Each socket presents a pair of grooves and slot therein engageable with male mating structure on a handle. The complementary socket/handle mating structure allows the handle to be positioned in a depending position when the seat is at a desired raised or lowered position. User rotation of the handle catches/locks the handle within the socket which allows the user to transfer forces from the handle to the seat so as to raise the same.

It is therefore a general object of this invention to provide a lift assembly for user manipulation of a toilet seat between elevated and horizontal positions without handling the toilet seat proper.

Another object of this invention is to provide a lift assembly, as aforesaid, which is easily attached to an existing toilet seat or can be incorporated therein during initial seat manufacture.

A still further object of this invention is to provide an assembly, as aforesaid, presenting first and/or second handles on opposed sides of the toilet seat proper.

Another object of this invention is to provide an assembly, as aforesaid, the assembly including a socket for releasably engaging a respective handle therein.

A further object of this invention is to provide an assembly, as aforesaid, the handles rotatable between a first position during use and a second position during nonuse.

Still a further object of this invention is to provide a socket/handle assembly, as aforesaid, which does not interfere with use of the toilet seat.

A further particular object of this invention is to provide a device, as aforesaid, the handles being removable for cleaning and disinfecting.

Another object of this invention is to provide a device, as aforesaid, which can be mounted to toilet seats of various designs.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Turning more particularly to the drawings, FIGS. 1–5 illustrate various portions of the lift assembly 100. As shown, the assembly 100 presents first 110 and second 210 depending handles to the user on opposed sides of the toilet seat proper 2000. The toilet seat 2000 is shown as being an uninterrupted rim, it being understood that assembly 100 can be used with various toilet seat design configurations including a split rim design.

Figure 2:
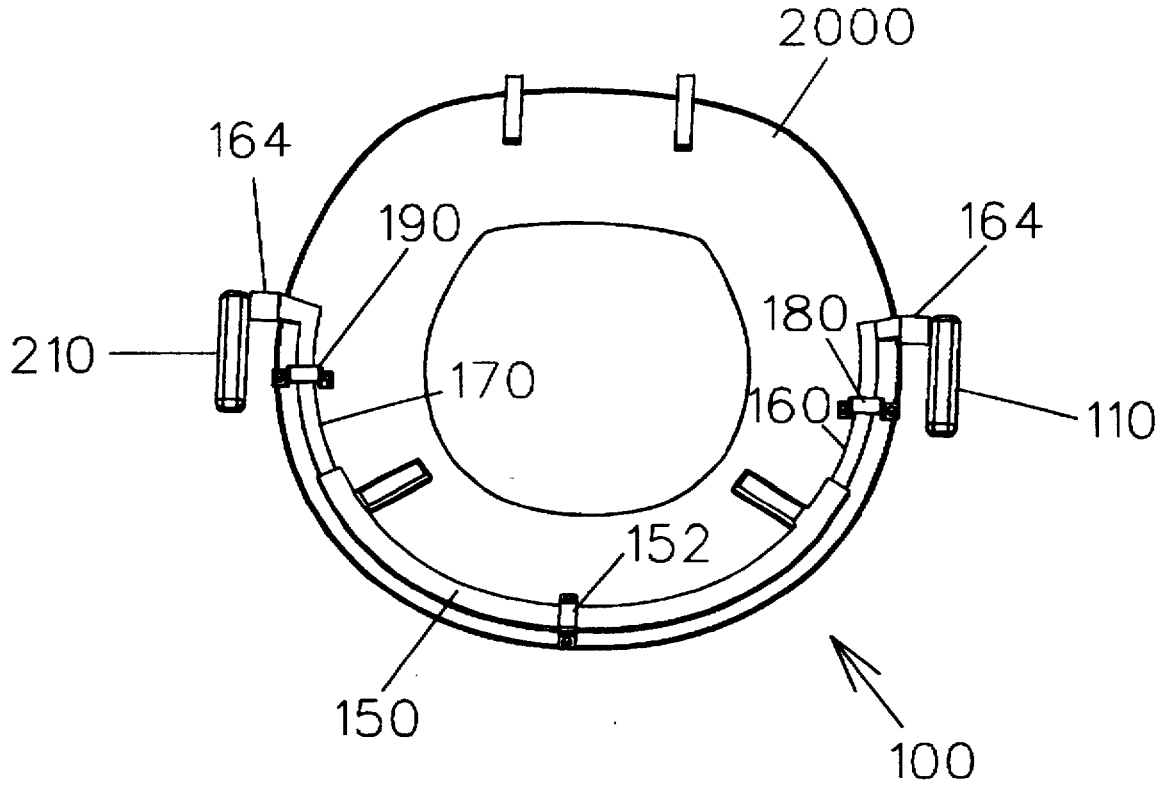
FIG. 2 is a bottom view of a toilet seat with the lift assembly installed thereon, the handles shown in a lifting position.
Figure 3:
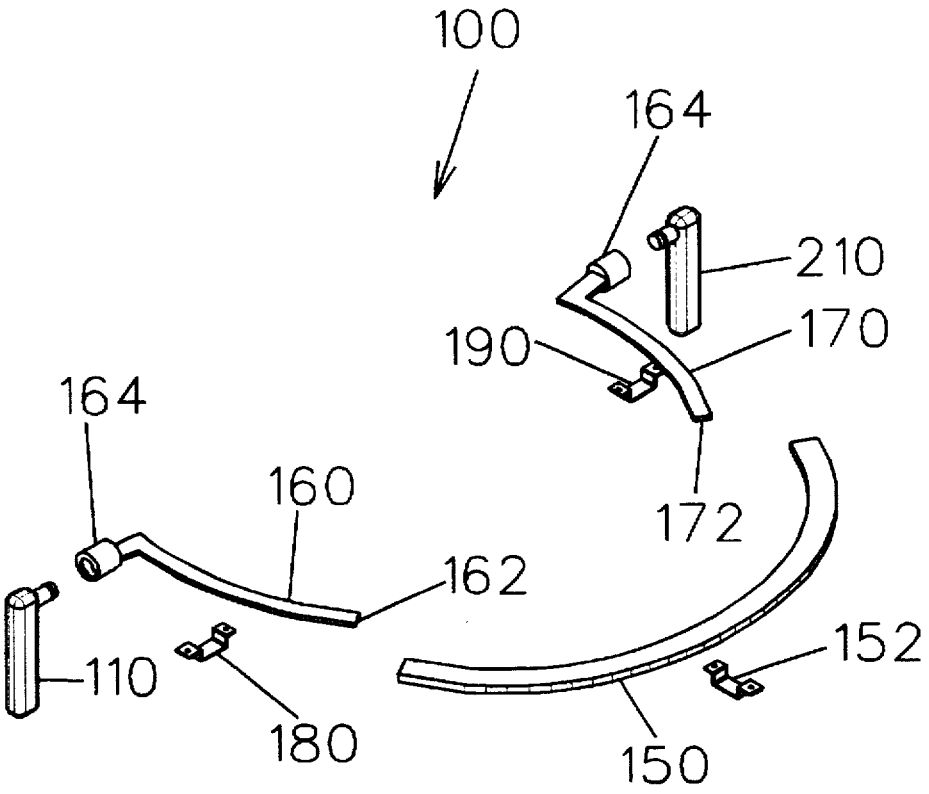
FIG. 3 is an exploded view of the lift assembly as removed from a toilet seat, the handles shown in a depending position.

As further shown in FIG. 2 the lift assembly 100 includes a first arcuate housing 150 attached to the underside of the toilet seat 2000 by bracket 152. The housing 150 presents apertures 153 at each end so as to slidably receive a free end of first and second arcuate arms 160, 170 therein. The free ends 162, 172 of each arm 160, 170 are adapted to slide into the apertures 153 presented at the ends of the mounting housing 150. The interior of housing 150 is adapted to receive each arm 160, 170 in a slidable/friction fit relationship therebetween. Thus, housing 150 functions as a support sleeve from which the length of arm 160, 170 extension can be variously adjusted. Brackets 180, 190 are attached to the underside of the toilet seat 2000 so as to offer underlying support to the respective arms 160, 170.

Figure 4:
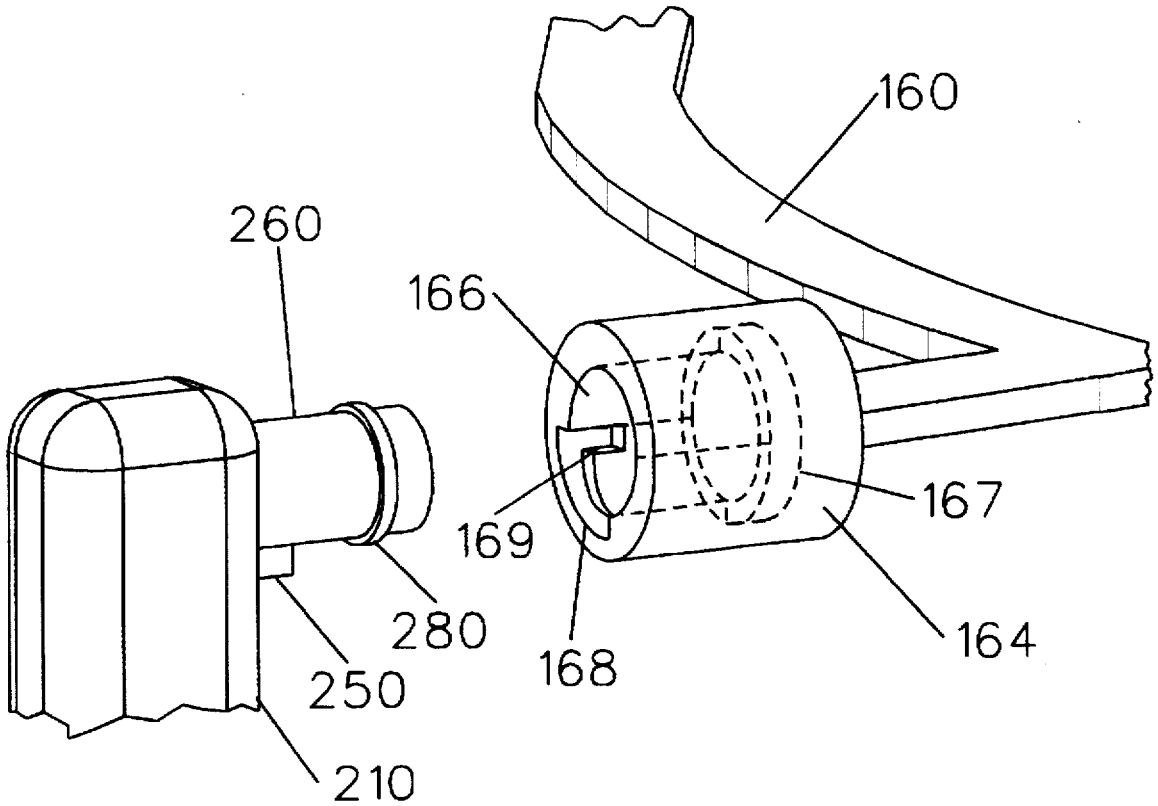
FIG. 4 is a rear fragmentary view, on an enlarged scale, showing the relationship between a handle and a socket of one arm of the lift assembly.
Figure 5:
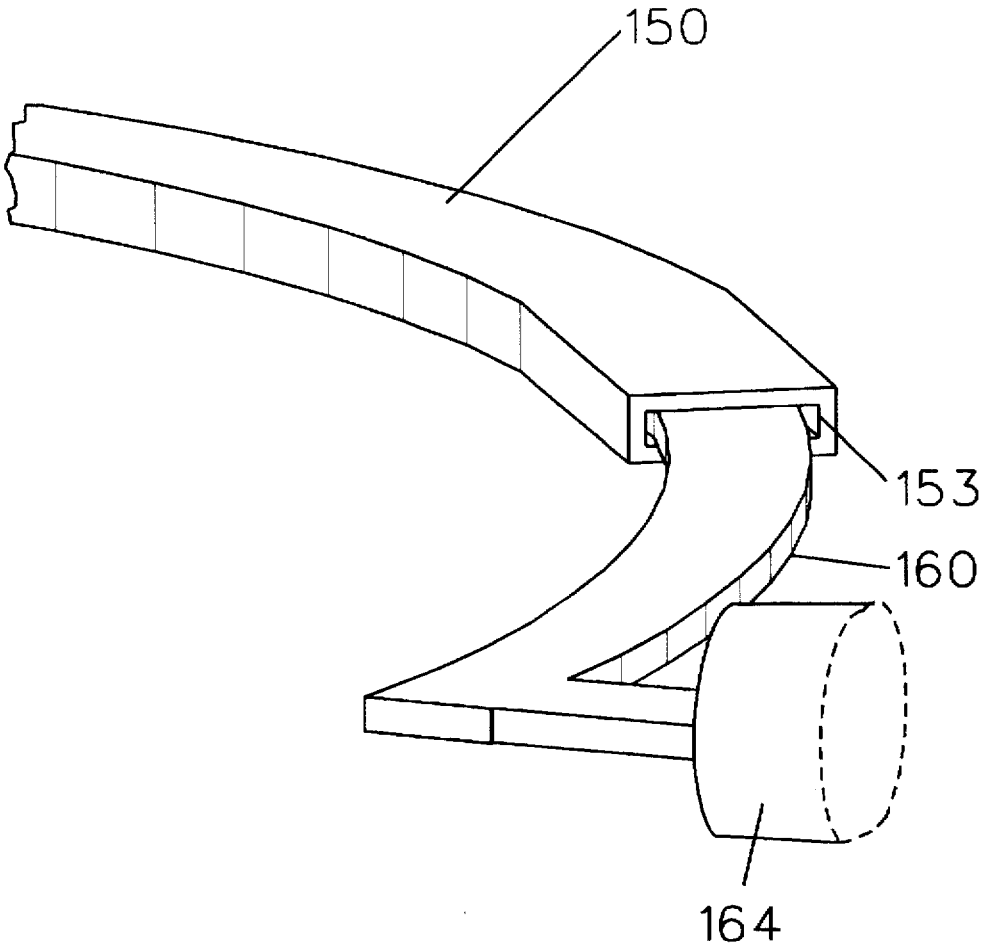
FIG. 5 is a front fragmentary view showing the slidable engagement of one arm within the mounting housing, the socket being diagrammatically shown at the end of the arm.

At the opposed end of each mounting arm 160, 170 is a socket 164, 174, the sockets being variously adjustable along each side of the seat 2000 by means of manipulation of the arms 160, 170. Each socket 164, 174 is as shown in FIG. 4 and presents a generally cylindrical bore 166. About the front of the bore 166 is a first groove 168 partially extending into the wall about the bore 166 circumference. A second groove/slot 169 in the bore 166 wall is perpendicular to groove 168. At the opposed end of bore 166 is a second annular groove 167. The grooves 167, 168 and slot 169 within bore 166 act as female fasteners for complementary male fasteners found on each handle 110, 210.

Figure 1:
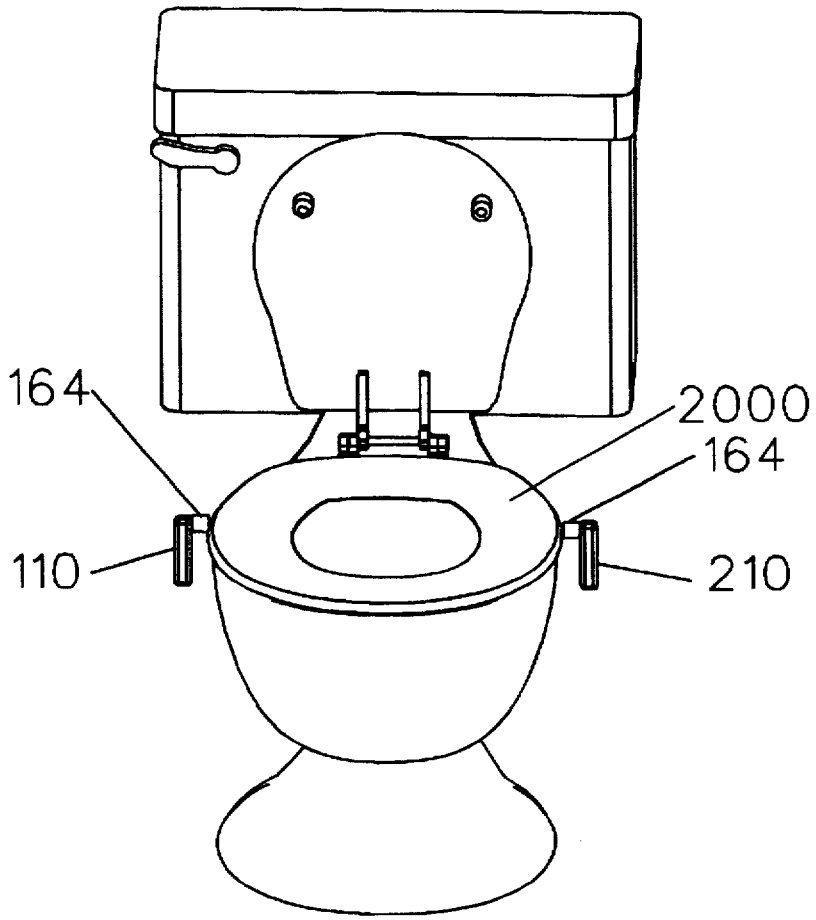
FIG. 1 is a front elevation view showing first and second handles of the lifting device projecting from opposed sides of the toilet seat proper.

Each handle 110, 210, one handle being shown in FIG. 4, further comprises a cylindrical hub 260 normally extending from the handle proper. The hub 260 has a diameter adapted to fit within the bore 166 of the respective socket 164, 174. About the end of hub 260 is an annular mounting ring/flange 280 adapted to releasably fit within the annular groove 167 at the distal end of each socket 164, 174. The width of groove 167 is greater than the width of the flange 280 to allow lateral play/movement therebetween. Extending from hub 260 and adjacent the handle proper is a tab/flange 250 which initially lies within groove 168 at the front of the bore 166 upon seating of flange 280 within groove 167. At this position the handles 110, 210 vertically depend from the respective sockets 164 as shown in FIG. 1.

To lift the toilet seat 2000 the user grasps either or both of the handles 110, 210 and rotates the same. During such rotation the flange 250 moves through groove 168 and can be laterally displaced into the slot 169 so as to be seated therein. This flange 250 seating precludes further rotation of the handle relative to the socket. Thus, further forces exerted by the user on the handle are transferred to the socket 164, 174 and ultimately to the toilet seat 2000 proper. The seat 2000 can be raised and/or lowered upon the user grasping the handle 110, 210 only. Upon positioning of the seat 2000 to a desired position, the flange 250 can be laterally displaced from slot 169 and moved through groove 168. This movement allows the handle 250 to be returned to a depending vertical position. Thus, handle will not interfere with conventional seat use. The lateral play between the annular flange 280 and groove 167 allows for a like lateral play of the flange 250 relative to slot 169. Thus tab/flange can be moved in and out of slot 169. Upon exertion of sufficient force on the handles 110, 210 the flange 280 will unseat from groove 167 for disengagement of handle 110, 210 from the respective socket 164, 174 so as to allow for cleaning, permanent removal, etc.

Although the socket structure as shown in FIG. 4 requires rotation of the handle towards the user so as to lift the seat 2000, it is understood that the socket structure may be reversed so that the handle must be rotated in an opposed direction to lift the seat 2000. It is also understood that only one handle 110 or 210 can be utilized, if desired. Also, the mounting housing 150 may be split into two separate pieces for housing each arm 160, 170 such as for use with a split rim/open front toilet seat.

It is to be understood that while certain forms of this invention have been illustrated and/or described, it is not limited thereto except insofar as such limitations are included in the following claims and allowable functional equivalents thereof.

Having thus described the invention, what is claimed as new and desired to be secured by Letters Patent is as follows:

1. A lift assembly for manipulation of a toilet seat mounted to a toilet bowl between a first horizontal position and a second vertical position relative to a toilet bowl, said assembly comprising:

a housing presenting at least one open end mounted to an underside of a toilet seat;

at least one arm mounted to an underside of a toilet seat, said arm having a free end for insertion into said at least one open end of said housing;

a socket attached to said arm, said mounted arm configured to position said attached socket at a side of the toilet seat;

a handle;

a hub extending from said handle;

means on said hub and said socket for releasably engaging said hub within said socket, a user manipulation of said engaged handle moving the seat from a horizontal position to a vertical position relative to a toilet bowl.

2. The assembly as claimed in claim 1 wherein said releasable engaging means comprises:

a bore in said socket presenting a wall;

a first flange about said hub;

a first complementary groove about said bore wall, said first hub flange adapted for a releasable seating within said first groove and movement therethrough.

3. The assembly as claimed in claim 2 wherein said releasable engaging means further comprises:

a second groove about said bore wall;

a slot in said bore wall and communicating with said second groove;

a second flange on said hub, said second hub flange initially positioned in said second groove upon said releasable engagement of said first hub flange in said first groove, said second hub flange moving through said second groove and seating in said slot during a user rotation of said handle relative to said socket, said seating transferring user forces exerted on said handle to said socket and the seat attached thereto, whereby to raise the seat upon a user manipulation of said handle.

4. The assembly as claimed in claim 3 wherein said width of said first groove relative to a breadth of said first hub flange allows for lateral movement of said first hub flange in said first groove, said lateral movement allowing for movement of said second hub flange in and out of said slot.

5. The assembly as claimed in claim 1 further comprising a bracket for supporting said at least one arm to an underside of the toilet seat.

6. The assembly as claimed in claim 1 wherein said at least one arm is slidable relative to said housing, said slidable arm variously adjusting a position of said socket at a side of the toilet seat.

7. The assembly as claimed in claim 3 wherein a width of said first groove relative to a breadth of said first hub flange allows for lateral movement of said first hub flange in said first groove, said lateral movement allowing for movement of said second hub flange in and out of said slot.

8. For use with a toilet seat mounted to a toilet bowl between a first horizontal position and a second vertical position relative to the toilet bowl, the improvement comprising a handle assembly, said handle assembly comprising:

a housing mounted to an underside of a toilet seat;

at least one arm mounted to an underside of a toilet seat and to said housing, said arm having an end extending beyond an end of said housing;

a socket attached to said arm end extending beyond said housing, said socket positioned at a side of the toilet seat;

a handle;

means on said handle and said socket for engaging said handle within said socket, a user manipulation of said handle locking said handle in said socket for moving the seat from a horizontal position to a vertical position relative to the toilet bowl upon user exertion on said handle.

9. The assembly as claimed in claim 8 wherein said engaging means comprises:

a hub extending from said handle;

male fastener means about said hub for engagement with a complementary fastener;

a bore in said socket;

female fastener means about said bore for presenting said complementary fastener for said male fastener means.

10. The assembly as claimed in claim 9 wherein said male fastener means comprises a flange about said hub.

11. The assembly as claimed in claim 10 wherein said female fastener means comprises a groove in said socket for releasably receiving said hub flange therein.

12. The assembly as claimed in claim 11 wherein said engaging means further comprises:

a second groove in said socket;

a slot in said socket and generally normal to said second groove;

a second hub flange displaced from said first hub flange, said second hub flange initially positioned in said second groove upon said releasable engagement of said first hub flange in said first groove, said second hub flange movable through said second groove and into said slot during a user rotation of said handle, said second hub flange in said slot precluding further handle movement for transferring user forces exerted on said handle to said socket and the seat attached thereto, whereby to move the seat from a horizontal to a vertical position upon manipulation of said handle.

13. The assembly as claimed in claim 8 wherein said arm is slidably mounted within said housing, whereby to adjust the extension of said arm end from said housing and a position of said socket attached thereto relative to the toilet seat.

14. In a toilet seat swingably mounted to a rim of a toilet bowl between a first horizontal position and a second vertical position relative to the toilet bowl rim, the improvement comprising:

at least one socket;

means associated with the toilet seat for positioning said at least one socket on at least one side of the toilet bowl;

a handle;

means on said handle and said at least one socket for engaging said handle to said at least one socket at a first position allowing for rotation of said handle relative to said at least one socket and a second position wherein said handle is fixed within said at least one socket, said fixed handle providing for a user transfer of forces on said handle to said at least one socket and associated toilet seat, whereby to move the seat between a horizontal position to a vertical position upon user manipulation of said handle.

15. The assembly as claimed in claim 14 wherein said engaging means comprises:

a bore in said socket;

a ring about said handle;

a first groove surrounding said bore, said ring adapted for a releasable seating within said first groove and movement therein.

16. The assembly as claimed in claim 15 wherein said engaging means further comprising:

a second groove about said bore;

a slot in said bore and in communication with said second groove;

a tab extending from said handle and displaced from said ring, said tab initially positioned in said second groove upon said engagement of said ring in said second groove, said tab moving in said first groove and seating in said slot during a user rotation of said handle, said tab seating precluding a further movement of said handle relative to said socket whereby to transfer forces exerted on said handle to said socket and the seat attached thereto, said force transfer moving the seat from the first to second position.

17. The assembly as claimed in claim 16 wherein a width of said first groove is greater than a width of said ring to allow lateral movement of said ring in said first groove, said lateral movement allowing for lateral movement of said tab in and out of said slot.

18. The assembly as claimed in claim 14 wherein said socket positioning means comprises:

an arm having first and second ends, said socket atached to said first arm end;

means on the toilet seat for slidably mounting said arm second end thereto, said slidable arm movement varying the position of said socket along a side of the toilet seat.

19. The assembly as claimed in claim 18 wherein said arm mounting means comprises:

a hosuing on an underside of the toilet seat;

an aperture at an end of said housing adapted to receive said arm in slidable movement therein.

20. The assembly as claimed in claim 14 wherein said handle first position vertically depends said handle from said socket with said second handle position being generally horizontal relative to said socket.

* * * * *

UNITED STATES PATENT AND TRADEMARK OFFICE

CERTIFICATE OF CORRECTION

PATENT NO. : 5,745,930

DATED : May 5, 1998

INVENTOR(S) : Christopher L. Fallen

It is certified that error appears in the above-identified patent and that said Letters Patent is hereby corrected as shown below:

Column 6, line 27, delete "atached" and substitute --attached--.

Column 6, line 35, delete "hosuing" and substitute --housing--.

Signed and Sealed this

Twenty-eighth Day of July, 1998

*Attest:*

*Attesting Officer*

BRUCE LEHMAN

*Commissioner of Patents and Trademarks*